US008690276B2

(12) United States Patent
Moore

(10) Patent No.: US 8,690,276 B2
(45) Date of Patent: Apr. 8, 2014

(54) MEDIA FLATNESS VERIFICATION AND PREVIEW MODE

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 200 days.

(21) Appl. No.: 13/423,390

(22) Filed: Mar. 19, 2012

(65) Prior Publication Data

US 2013/0241982 A1 Sep. 19, 2013

(51) Int. Cl.
*B41J 25/308* (2006.01)

(52) U.S. Cl.
USPC ..... 347/8; 347/14; 347/16; 347/19; 347/101; 347/105

(58) Field of Classification Search
USPC ..... 347/8, 14, 16, 19, 101, 104, 105, 106
See application file for complete search history.

(56) References Cited

U.S. PATENT DOCUMENTS

| | | | | |
|---|---|---|---|---|
| 7,044,575 | B2 * | 5/2006 | Kelley et al. | 347/19 |
| 7,775,733 | B2 * | 8/2010 | Noda et al. | 400/709 |
| 2009/0154976 | A1 * | 6/2009 | Castillo et al. | 399/406 |

* cited by examiner

*Primary Examiner* — Juanita D Jackson
(74) *Attorney, Agent, or Firm* — Hoffman & Baron, LLP

(57) ABSTRACT

A printer and method of printing wherein a preview mode conveys media through the printer in a manner that avoids the possibility that the media can contact a print head. A hold-down system of the printer and/or media transport generates a hold-down pressure applied to the substrate media in the direction of the first media transport. A precurler unit applies a predetermined degree of curl to the substrate media. A media height sensor determines the height of the substrate media above the first media transport under the influence of the hold-down pressure. A print head array marks the substrate media with an image in the marking zone, and an actuator adjusts the relative spacing between the print head array and the first media transport. The gap between print head and the media is adjustable in view of the measurements.

20 Claims, 3 Drawing Sheets

MEDIA FLATNESS VERIFICATION AND PREVIEW MODE

BACKGROUND

1. Field of the Disclosure

The present disclosure relates to methods of document creation. More specifically, the present disclosure is directed to an apparatus and method for printing in which the media flatness is verified before printing in a preview mode and/or during printing.

2. Brief Discussion of Related Art

In certain printers using ink jet direct marking technology, it is expected that marking inks, e.g., solid inks, UV gel inks, aqueous inks and others, will be jetted directly onto cut sheet substrate media. A critical parameter in this printing process is the size of the printhead-to-media gap. In certain current technology, the gap is set as small as 0.5 mm in order to minimize the pixel placement errors due to misdirected jets. For other printheads, for example those having high drop velocity, it is possible that the gap can be opened to 0.75-1.0 mm. Nevertheless, these tight printhead to media gaps pose a challenge for any cut sheet printer, since the sheet lead edge (LE) and trail edge (TE), and to a less extent the sheet body are generally not perfectly flat.

For accurate pixel placement and color registration, it is desired to keep the printhead-to-media gap within a +/−0.1 mm range about the nominal. To avoid printhead front face damage, under no circumstances is the media allowed to "close the gap", i.e., to contact the printhead. Both vacuum and/or electrostatic escort belt technology are employed to hold cut sheets of substrate media sufficiently flat. However, neither technology is robust against LE & TE upcurl.

On solution to the problem of upcurl is that a cut sheet printer may have a precurler subsystem which biases all sheets into a downcurl mode. However, if an operator places a stack in the feed tray with non-uniform curl, such as edge wave, corner curl, or cockle, it will be difficult for the precurler to produce sufficient downcurl from the very first sheet of a job. Hence, sheets may not be held sufficiently flat in the print zone, to the extent that a shutdown of the printer would be necessary to avoid the uncurled media contacting the printheads.

SUMMARY

In order to overcome these and other weaknesses, drawbacks, and deficiencies in the known art, provided according to the present disclosure is a printer having a first media transport operative to receive a substrate media, and to convey the substrate media towards, into, through, out of or away from a marking zone of the printer. The marking zone is an area associated with the printer in which the substrate media is marked with an image. Generally, though no exclusively, the first media transport comprises a belt routed over a plurality of rollers, the belt being moved and moveable under the influence of a motive force applied to at least one roller among the plurality of rollers.

A hold-down system of the printer and/or first media transport, optionally a vacuum powered hold-down system, an electrostatic hold-down system, or a combination of the two, generates a hold-down pressure applied to the substrate media in the direction of the first media transport. A precurler unit is operative to apply a predetermined degree of curl to the substrate media. A media height sensor determines the height of the substrate media above the first media transport under the influence of the hold-down pressure. A print head array marks the substrate media with an image in the marking zone, and an actuator adjusts the relative spacing between the print head array and the first media transport. The actuator may include at least one of a linear and rotary actuator, powered by at least one of a fluid or electric motive power, and be configured to move at least one or both of the print head array and the first media transport to alter the distance between the two.

The actuator is operative to set the gap between the transport and the print head array at a first relative spacing at which marking of the substrate media may selectively occur, or a second relative spacing greater than the first spacing, at which no marking occurs. A controller may be provided, configured and operative to direct the substrate media into the marking zone with the actuator set at the second relative spacing prior to directing substrate media through the print zone with the actuator set at the first relative spacing for marking.

The printer may optionally include a media feeding unit for supplying substrate media to the printer, the media feeding unit having a plurality of selectable trays from which substrate media is selectably sourced. A precurl may apply a selectable degree of precurl to the substrate media.

The printer may include a duplex path to enable duplex printing on the substrate media, and a diverter to divert substrate media from a process path to the duplex path. A controller may be provided, operative to detect a change in a source of substrate media and to initiate a preview mode of operation to characterize the flatness properties of the substrate media while subjected to the hold-down pressure.

Also provided according to the instant disclosure is a method of printing including delivering a substrate media from a media source to a printer having a first media transport, the first media transport including a hold-down system operative to generate a hold-down pressure applied to the substrate media in the direction of the first media transport, the substrate media having a predetermined degree of downcurl applied thereto. An adjustable gap between a print head array of the printer and the first media transport is maximized, and the substrate media in conveyed using the first media transport towards, into, through, out of or away from a marking zone of the printer under the influence of the hold-down pressure. Here again, the marking zone is an area associated with the printer in which the substrate media is marked with an image.

The method includes determining whether a height of the substrate media having the predetermined downcurl, under the influence of the hold-down pressure, exceeds a maximum height for operation of the printer, and setting the adjustable gap between the print head array and the first media transport to a nominal operating value in response to determining that the height of the substrate media does not exceed the maximum for operation of the printer. The predetermined degree of downcurl applied to the substrate media in increased in response to determining that the height of the predetermined quantity of substrate media exceeds the maximum for operation of the printer.

Where the printer includes a precurl unit operative to apply a selectable degree of precurl to the substrate media, the predetermined and/or increased degree of downcurl is applied to the substrate media is applied by the precurl unit. Having an increased degree of downcurl, the substrate media is conveyed towards, into, through, out of or away from the marking zone of the printer under the influence of the hold-down pressure; and it is determined whether a height of the substrate media having the increased degree downcurl, under the influence of the hold-down pressure, exceeds a maximum height for operation of the printer.

Optionally, the printer includes an inverter operative to invert the orientation of the substrate media, and the method further includes selectively inverting the orientation of the substrate media using the inverter. The printer optionally includes a duplex path to enable duplex printing on the substrate media, and a diverter operative to divert substrate media from a process path to the duplex path. In that case, delivering the substrate media from a media source to a printer includes delivering a predetermined number of pieces of cut sheet media equal to or less than a capacity of the duplex path.

The method optionally includes tacking the substrate media to the first media transport, as an illustrative example only by pressing the substrate media against the first media transport with a roller.

In some embodiments of the method disclosed herein, determining whether a height of the substrate media exceeds a maximum height for operation of the printer comprises using a sheet height sensor to measure the height of the substrate media on the first print zone transport under the influence of the hold down pressure. Under those circumstances, optionally the nominal operating value of the adjustable gap between the print head array and the first media transport is determined based upon the measured the height of the substrate media on the first print zone transport under the influence of the hold down pressure.

These and other purposes, goals and advantages of the present disclosure will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings, in which like reference numerals refer to like structures across the several views, and wherein.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a cut sheet of paper, a continuous web of paper, a ream of paper, etc.), transparencies, parchment, film, fabric, plastic, vellum, paperboard up to between about 26 and 29 point (i.e., about 0.026-0.029 in. thickness) or other substrates on which an image can be printed or disposed.

As used herein "process path" refers to a path traversed by a unit of substrate media through a printer to be printed upon by the printer on one or both sides of the substrate media. A unit of substrate media moving along the process path from away from its beginning and towards its end will be said to be moving in the "process direction".

As used herein, "transport" when used as a noun, "media transport" or "transport apparatus", each and all refer to a mechanical device operative to convey a substrate media through a printer.

As used herein, "upcurl", is substrate media curvature towards the printhead, in other words curl around a radius centered on the side of a cut sheet substrate media in the same direction as the printhead.

As used herein, "downcurl" is curvature in the substrate media around a radius centered on the side of the cut sheet away from the printhead, for example in the direction of an escort belt.

DESCRIPTION

Figure 1:
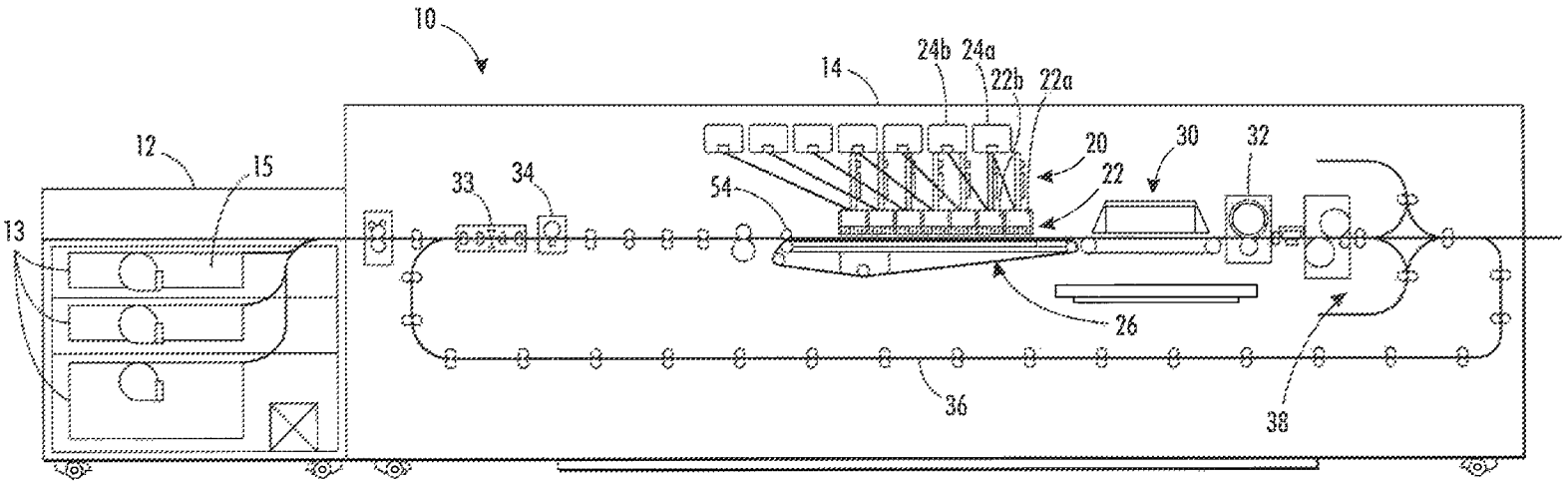
FIG. 1 illustrates schematically a printer according to an exemplary embodiment of the present disclosure.

Referring now to FIG. 1, illustrated is a printer, generally 10, according to a first embodiment of the present disclosure. The printer 10 may include a media feeding unit 12 in which one or more types of substrate media 15 may be stored and from which the substrate media 15 may be fed, for example sheet-by-sheet feeding of a cut sheet medium, to be marked with an image. The media feeding unit 12 delivers substrate media 15, for example from one or more media trays 13, to a marking unit 14 to be marked with a document image. The marking unit delivers marked substrate media 15 to an interface module (not shown) which may, for example, prepare the substrate for a finishing operation. Optionally the printer 10 may include a finishing unit (not shown), which receives printed documents from the interface module. The finishing unit, for example, finishes the documents by stacking, sorting, collating, stapling, hole-punching, or the like.

Marking unit 14 includes a marking zone, generally 20, within the marking unit 14. A marking zone 20 encompasses a marking engine, in this example an ink jet marking engine, having one or more print heads 22*a*, 22*b*, etc., collectively print head array 22, any of which are operative to directly mark the substrate media 15 and thereby form an image on the substrate media 15. Ink jet print head configuration is not the exclusive marking engine, and is offered as an example only. The ink jet print heads 22*a*, 22*b*, etc. may draw ink from respective reservoirs 24*a*, 24*b*, etc., or in some instances a collective reservoir (not shown). A marking zone transport 26 is operative to hold a substrate media 15 to itself securely, for example by electrostatic means or vacuum means, without limitation. In other embodiments, the marking engine may comprise any technology for printmaking or document creation in which a controlled gap must be maintained between the marking member and the surface of the substrate media 15.

The marking zone transport 26 is further operative to receive a substrate media 15 delivered towards the marking zone 20, for example from roller nips 28, and to convey the substrate media 15 towards, into, through, out of, and/or away from the marking zone 20, with positive control of the motion of the substrate media 15. The marking zone transport 26 maintains the substrate media 15 within the marking zone 20 in sufficient proximity to the print head array 22 to permit print heads 22*a*, 22*b*, etc. to mark the substrate media 15, but is designed and operated to avoid any contact between the substrate media 15 and the print head array 22. Contact between the substrate media 15 and the print head array 22 is to be avoided to negate the possibility of damage to the precise size and shape of the ink jet openings in the print head array, or to any coatings applied thereto, for example those which may facilitate precise ink particle/droplet formation. Such damage may be caused by impact or abrasion due to contact with the substrate media 15. Contact between the substrate media 15 and the print head array 22 may also be the cause media jams leading to unscheduled stoppage of printing, wasting media and ink, requiring attention to service the error, and generally lead to customer dissatisfaction.

The marking zone transport 26 is configured and operative to pass the substrate media 15 to a downstream transport 30 for further handling. As example only, the downstream transport 30 includes a leveler transport, whose function is to bring all jetted ink to the same elevated temperature. The downstream transport 30 receives the substrate media 15 from the marking zone transport 26 and deliver the substrate media 15 to be subjected to a post-marking process 32, including without limitation ultra-violet light curing, fusing, spreading, drying, etc., any or some combination of which may be included without departing from the scope of the instant disclosure. In the present embodiment, including an ink jet print head array 22, the post-marking process includes a spreader nip, where the ink is spread under high pressure and elevated temperature to its final film thickness on the media. The post-marking process 32 may of course be omitted, if desired.

Included in the marking unit 14 are a curl sensor 33 and precurler unit 34, preferably upstream in the process path of the marking zone transport 26. The precurler unit 34 is operative to apply a selectable degree of pre-curl to the substrate media 15. In particular, a degree of curl in the substrate media 15 is detected by curl sensor. The precurler unit 34 receives output from the curl sensor 33 in setting a desired degree of precurler. Also included in the marking unit 14 is a duplex path 36, operative to selectively return printed cut sheet documents to the print zone, for example to be imaged in duplex, i.e., on a reverse side thereof. A document inverter 38, operative to invert the orientation of the cut sheet substrate media 15 to facilitate printing on the reverse side thereof, may be located in the process path upstream of the diversion point 39 for the duplex imaging path 36, or optionally in the duplex path 36 as shown.

Figure 2:
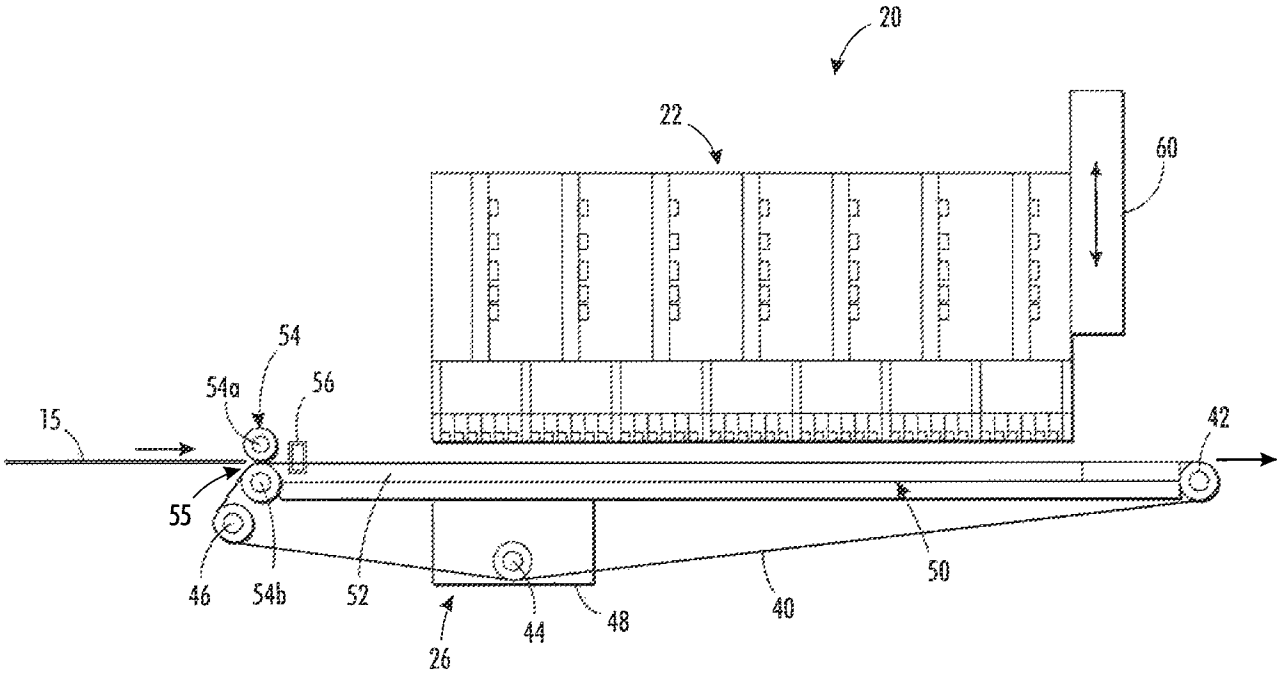
FIG. 2 illustrates schematically a print zone of the printer.

Referring now to FIG. 2, illustrated schematically is a print head array 22 and marking zone transport 26 in closer detail. Marking zone transport 26 includes an endless belt 40 in a path around rollers including 42, 44 and 46. In this case, roller 42 serves as a drive roller, roller 44 a tensioning roller, and roller 46 a steering roller. Other configurations will be seen as within the scope of the present disclosure to one skilled in the art. A marking zone transport drive unit 48 controls the motion of the drive roller 42 by commanding a motor (not shown) operatively connected with the drive roller 42.

The endless belt 40 in certain embodiments is air-permeable, and platen 50 may include a vacuum hold-down manifold 52 positioned beneath the endless belt 40, including where the endless belt 40 passes beneath the print head array 22. As described, the endless belt 40 lies at least in part between the vacuum hold-down manifold 52 and the print head array 22. The vacuum hold-down manifold 52 introduces a negative atmospheric pressure at its top surface, which in turn draws air through the air-permeable endless belt 40. A unit of substrate media 15 lying on the endless belt 40 is therefore drawn against endless belt 40 by the air flow which passes through the endless belt 40 and the vacuum hold-down manifold 52, and also by the air pressure differential between opposing sides of the substrate media 15 under the operation of the vacuum hold-down manifold 52. The vacuum hold-down manifold 52 is in fluid communication with a source of negative vacuum air pressure via a vacuum line (not shown). Flow through line may be optionally controlled or varied, for example by provision of a flow control valve, pressure regulator, or the like. Alternately, the vacuum source may itself be configured to provide variable vacuum pressure.

Alternately, or in addition, to the vacuum hold-down means described above, the print zone transport may be provided with an electrostatic hold-down means. In one embodiment, an electrostatic charge is applied onto the upper surface of sheet 15 while an equivalent opposite polarity electrostatic charge is deposited onto the lower surface of belt 40. The opposite charges are attracted to each other and a tack pressure is developed between sheet 15 and belt 40.

Further illustrated in FIG. 2 is a tacking roll 54, in this case a pair of tacking rolls 54*a*, 54*h* with one roll of the pair each above and beneath, respectively, the endless belt 40. In operation, substrate media 15 is delivered to the tacking roll 54 adjacent the endless belt 40. The tacking roll 54 presses the substrate media 15 towards the endless belt 40 at a tacking nip 55, in order to initiate and/or assist the hold-down pressure applied by the print zone transport 26 and to "tack" the substrate media 15 to the endless belt 40. Tacking rolls 54*a* and 54*b* may be electrically biased so as to apply the electrostatic charges to the substrate media 15 and/or the surface of the endless belt 40 as previously described The print zone transport further includes a sheet height sensor 56, for example an optical sensor, measuring across the width of the endless belt 40. The sheet height sensor 56 will output a signal that is related to the height of any object that obstructs its view across the endless belt 40. In certain embodiments the sensor 56 is operative to output a varying signal correlated with the detected height of the substrate media 15. In other embodiments, the sensor 56 is configured as a go/no-go sensor, having a binary output that is dependent upon whether the substrate media 15 exceeds a threshold height. In this case, the threshold height may be automatically adjustable by a controller, for example, as a function of the media type.

The print zone transport 26 and/or the print head array 22 may each be mounted by, on or to a frame or chassis portion of the marking unit 14. Furthermore, the print head array 22 may be mounted in order to permit it to adjust position with respect to the print zone transport 26. The adjustment can be controlled, for example, by an actuator 60. The gap between a print head array 22 and the substrate media 15 is preferably variable between at least a nominal operating gap at which printing may occur, and a second greater gap for a preview mode during which no printing occurs. Actuator 60 may be driven electrically, or by fluid power, and may be linear and/or vertical, as in the embodiment shown, or also rotary in nature (rack-and-pinion, rotary levers, etc.). The actuator 60 may also include an encoder (not shown) to provide feedback concerning the position of the print head array 22. Alternately or additionally the print zone transport, and/or at least the platen 52 portion thereof that underlies the print head array, may be mounted for adjustable motion with respect to the print head array. Here again, the actuation may be driven by a variety of motive power sources, and/or in either a linear or rotary fashion, and optionally be associated with some form or positional feedback indication, e.g., an encoder.

Figure 3:
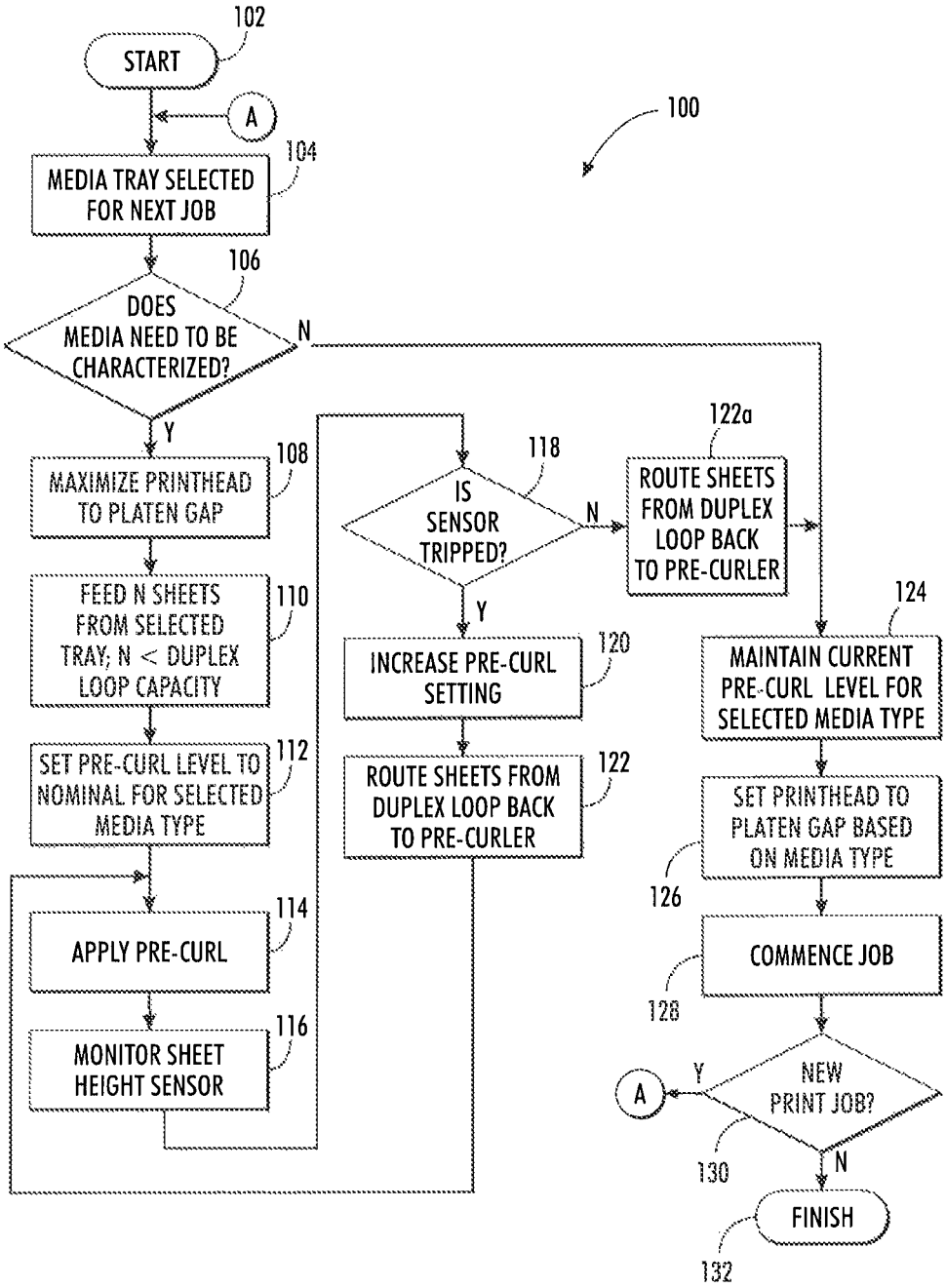
FIG. 3 depicts a flowchart showing an exemplary mode of operation according to the present disclosure.

Referring now to flowchart 100 depicted in FIG. 3, an exemplary mode of operation will be described. Beginning from a start condition 102, a substrate media source is selected 104 for the print job to be executed. For example, a media tray 13 may be chosen from those available in the media feeding unit 12 from which to deliver a particular substrate media 15 stored therein. This choice can be informed by data identifying the type of media stored in each or any particular media tray 13. The system next determines 106 whether the media type at the selected source needs to be characterized. Where the printer 10 has not previously used a particular media source in a previous job, then the substrate media 15 from that source will generally be classified as uncharacterized. This characterization may be referred to as a preview mode, in that the printer operates in a 'preview' fashion, with no printing occurring.

Generally, any change in the state of the media source, e.g., media tray 13, will require a characterization of the media, particularly its flatness properties. One or more sensors associated with the open-close state of the media tray 13, or the height of substrate media 15 can detect changes including a refill of the media tray 13, or a substitution of media type. Even a refill with substrate media 15 of the same type indicates the need for characterization. The added media may have different curl characteristics than the previous contents of the tray 13, even if they are of the same type. A media source will require characterization as well from an initial state, for example in response to a new or replaced media feeding unit 12 being associated with the marking unit 14, or where new or additional media trays 13 are added to an existing media feeding unit 14.

If it is determined that the media needs to be characterized, a "Y" result at 106, the gap between the print head array 22 and the platen 50 is set to its maximum 108, for example by the operation of actuator 60, or similar as already described. A sample number "N" sheets of substrate media 15 are fed 110 from the through the process path of the print module 14 from the selected media tray 13. The number N is preferably selected to not exceed the media-holding capacity of the duplex path 36. By doing so, following the characterization of the media, all of the N sample sheets of substrate media 15 can be redirected to the print zone 20 to be printed upon, thereby reducing waste. The characterization sets a nominal level of pre-curl 112 to be applied, for example in the precurler unit 34.

Beyond the precurler unit 34, substrate media 15 is fed to the print zone transport 26. In so doing, the height of the media is detected 118, for example by the sheet height sensor 56. Uncharacterized sheets of substrate media 15 found to be unsuitable for marking due to excessive height can be directed to the duplex path 36, preferably without inversion, in order to deliver the sheets to the precurler unit 34 an additional time. In such a case, the detected height exceeds an acceptable level as determined at 118, then the pre-curl setting at precurler unit 34 is increased at 120. The N sample sheets may be routed 122 back to the precurler unit 34, via duplex path 36, where the level of pre-curl set at 120 is then applied at 114. This process may be iteratively performed until an acceptable level of precurl and/or sheet height is obtained, or some other terminating condition is reached.

If, on the other hand, the height of the substrate media 15 as detected by the sensor 56 does not exceed an allowable threshold, i.e., a "N" outcome at decision 118, then the current level of pre-curl set at either 112, or 120, as applicable, is maintained at 124 for the selected type of media from the selected media source. In this case, the N number of sample sheets of substrate media 15 can be redirected **122*a* to the print zone 20, for example via pre-curler unit 34, to be printed upon, thereby reducing waste. Where it is confirmed (by a controller or operator, for example) that the height of the uncharacterized sheets remains below the maximum height for operation, then this media can be considered 'characterized' Substrate media 15 that has been characterized at a known precurler unit 34 setting is considered eligible for subsequent marking. Thus, characterized substrate media 15 is known to respond well to the selected precurl level and can be expected to remain sufficiently flat under the influence of the hold-down pressure to permit marking to occur. It will be further appreciated at this point that, should the outcome of decision 106 be "N", i.e., that the media source does not require characterization, the process diverts to 124**, i.e. maintaining the level of pre-curl already determined for the particular characterized media source.

Thereafter, the gap between the print head array 22 and the platen 50 is returned to a nominal operating state for the given type of substrate media 15 and/or media source, 126. Execution of the print job may commence at 128. The substrate media 15 used in the print job at 128 preferably includes any media 15 of the same type from the same source as may be resident in the duplex path 36 by operation of the characterization process described above. Upon completion of the print job, if more jobs are waiting, at decision 130 the process reverts to a media source selection 104 for the next job. Otherwise, the process may terminate 132.

In a further embodiment of the present disclosure, the sheet height sensor 56 makes not only a threshold measurement, i.e., whether or not the substrate media 15 height exceed the limit for safe operation. The sheet height sensor may be further operative to determine the height of the substrate media above the print zone transport 26, in particular the endless belt 40 as it sits on the platen 50. Data collected across a sheet of substrate media 15 and/or across several such sheets of the same source or type may be combined (e.g., median, average, etc.) to characterize the height of the substrate media 15. This detected information may be used in precisely setting a gap distance, e.g., by actuator 60 or the like. In any case, by use of the sheet height sensor 56 it will be confirmed (for example by the controller) at all times the maximum height of the substrate media 15 is less than the nominal operating gap between the print head array and the print zone transport 26 and/or platen 50.

The operation of the media height sensor 56 is described as in the so-called preview mode, i.e., when the gap between the print head array 22 and the platen 50 and/or print zone transport 26 is set to a value greater than the nominal operating gap at which printing may take place. In some embodiments, the gap between the print head array 22 and the platen 50 and/or print zone transport 26 in a preview mode represents a maximum such gap obtainable. Among other functions, this allows a configuration of the precurl of substrate media 15 according to a particular type and/or source, but characteristics common to more than one piece of substrate media 15. It will be appreciated that the output of the media height sensor 56 may also be monitored during the printing operation per se, as a guard against defective substrate media as may be introduced by a defect of supply or created by a malfunction of printer operation. Such monitoring may lead to the emergency shutdown of the marking zone transport 26 and/or associated transports (e.g., 30), or the printer 10 itself.

It will be appreciated by those skilled in the art that the sensor interpretation and/or decisions described above may be carried out by a machine operator having a suitable interface mechanism, and/or more typically in an automated manner, for example by operation of a controller having a processor executing a system of instructions stored on a machine-readable medium, RAM, hard disk drive, or the like. The instructions will cause the printer 10 to operate in accordance with the present disclosure.

Variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

I claim:

1. A printer comprising:

a first media transport operative to receive a substrate media and to convey the substrate media into, through, or out of a marking zone of the printer, the marking zone being an area associated with the printer in which the substrate media is marked with an image;

a hold-down system operative to generate a hold-down pressure applied to the substrate media in the direction of the first media transport;

a precurler unit operative to apply a predetermined degree of curl to the substrate media;

a media height sensor operative to determine the height of the substrate media above the first media transport under the influence of the hold-down pressure;

a print head array operative to mark the substrate media with an image in the marking zone;

an actuator operative to adjust the relative spacing between the print head array and the first media transport between a first relative spacing at which marking of the substrate media may selectively occur and a second relative spacing greater than the first spacing at which no marking occurs; and a controller configured and operative to direct the substrate media into the marking zone with the actuator set at the second relative spacing prior to directing substrate media through the print zone with the actuator set at the first relative spacing for marking.

2. The printer according to claim 1, further comprising:

a media feeding unit operative to supply substrate media to the printer, the media feeding unit having a plurality of selectable trays from which substrate media is selectable sourced.

3. The printer according to claim 1, further comprising:

a precurler unit operative to apply a selectable degree of precurl to the substrate media.

4. The printer according to claim 1, further comprising:

a duplex path configured to enable duplex printing on the substrate media; and a diverter operative to divert substrate media from a process path to the duplex path.

5. The printer according to claim 1, wherein the actuator comprises at least one of a linear and rotary actuator, and is powered by at least one of a fluid or electric motive power, the actuator being configured to move at least one of the print head array and the first media transport to alter the distance between the two.

6. The printer according to claim 1, wherein the hold-down system comprises a vacuum powered hold-down system, an electrostatic hold-down system, or a combination of the two.

7. The printer according to claim 1, wherein the controller is further operative to detect a change in a source of substrate media and to initiate a mode of operation to characterize the flatness properties of the substrate media while subjected to the hold-down pressure.

8. The printer according to claim 1, wherein the first media transport comprises belt routed over a plurality of rollers, the belt being moved under the influence of a motive force applied to at least one roller among the plurality of rollers.

9. A method of printing comprising:

delivering a substrate media from a media source to a printer having a first media transport, the first media transport including a hold-down system operative to generate a hold-down pressure applied to the substrate media in the direction of the first media transport, the substrate media having a predetermined degree of downcurl applied thereto;

maximizing an adjustable gap between a print head array of the printer and the first media transport;

conveying the substrate media using the first media transport into, through, or out of a marking zone of the printer under the influence of the hold-down pressure, the marking zone being an area associated with the printer in which the substrate media is marked with an image;

determining whether a height of the substrate media having the predetermined downcurl, under the influence of the hold-down pressure, exceeds a maximum height for operation of the printer; and setting the adjustable gap between the print head array and the first media transport to a nominal operating value in response to determining that the height of the predetermined quantity of substrate media does not exceed the maximum for operation of the printer.

10. The method according to claim 9, further comprising:

increasing the predetermined degree of downcurl applied to the substrate media in response to determining that the height of the predetermined quantity of substrate media exceeds the maximum for operation of the printer.

11. The method according to claim 10, wherein the printer includes a precurler unit operative to apply a selectable degree of precurl to the substrate media, and the increased degree of downcurl applied to the substrate media is applied by the precurler unit.

12. The method according to claim 11, further comprising:

transporting the substrate media having the increased degree of downcurl using the first media transport into, through, or out of the marking zone of the printer under the influence of the hold-down pressure; and determining whether a height of the substrate media having the increased degree downcurl, under the influence of the hold-down pressure, exceeds a maximum height for operation of the printer.

13. The method according to claim 9 where in the printer includes an inverter operative to invert the orientation of the substrate media, the method further comprising:

selectively inverting the orientation of the substrate media using the inverter.

14. The method according to claim 9 wherein the printer includes a duplex path to enable duplex printing on the substrate media and a diverter operative to divert substrate media from a process path to the duplex path, the substrate media comprising a cut-sheet substrate media, and wherein delivering the substrate media from a media source to a printer comprises delivering a predetermined number of pieces of cut sheet media equal to or less than a capacity of the duplex path.

15. The method according to claim 14, where in the printer includes an inverter operative to invert the orientation of the substrate media, the method further comprising:

selectively inverting the orientation of the substrate media using the inverter.

16. The method according to claim 9, further comprising:

tacking the substrate media to the first media transport.

17. The method according to claim 16, wherein tacking comprises pressing the substrate media against the first media transport with a roller.

18. The method according to claim 9, wherein determining whether a height of the substrate media exceeds a maximum height for operation of the printer comprises using a sheet height sensor to measure the height of the substrate media on the first print zone transport under the influence of the hold down pressure.

19. The method according to claim 18, wherein the nominal operating value of the adjustable gap between the print head array and the first media transport is determined based upon the measured the height of the substrate media on the first print zone transport under the influence of the hold down pressure.

20. The method according to claim 9, wherein the printer includes a precurler unit operative to apply a selectable degree of precurl to the substrate media, and the predetermined degree of precurl is applied by the precurler unit.

* * * * *